United States Patent [19]

Paoli

[11] 4,434,926

[45] Mar. 6, 1984

[54] TRANSPORTATION DEVICE, IN PARTICULAR FOR SHAPED, FLEXIBLE MATERIAL

[75] Inventor: Bruno Paoli, Fornacette-Pisa, Italy

[73] Assignee: International Paper Company, New York, N.Y.

[21] Appl. No.: 302,394

[22] Filed: Sep. 15, 1981

[51] Int. Cl.[3] ..... B65H 17/34

[52] U.S. Cl. ..... 226/172; 226/173

[58] Field of Search ..... 226/170, 171, 172, 173; 271/6, 7

[56] References Cited

U.S. PATENT DOCUMENTS

| | | | |
|---|---|---|---|
| 1,258,327 | 3/1918 | Ferres | 226/171 |
| 2,017,459 | 7/1932 | Howe et al. | 226/173 E X |
| 3,246,816 | 4/1966 | Dexter et al. | 226/173 X |
| 3,256,558 | 8/1964 | Andersen | 226/173 X |
| 3,323,703 | 6/1967 | Wibbing et al. | 226/173 |
| 3,351,034 | 11/1967 | Grek | 226/173 X |
| 3,580,451 | 9/1969 | Fraitzl | 226/173 E X |
| 3,606,810 | 5/1969 | Kozij | 226/173 E X |
| 3,868,053 | 2/1975 | Arnold | 226/173 E X |

*Primary Examiner*—Stuart S. Levy
*Assistant Examiner*—Daniel P. Stodola
*Attorney, Agent, or Firm*—Bucknam and Archer

[57] ABSTRACT

A machine for transporting a web particularly a web of flexible material of indefinite length. The device comprises a pair of rotary clamping groups, each clamping group having the form of an endless carrier of clamps. Each rotary clamping group is pivotally adjustably attached to a frame support structure at its lower portion, to thereby admit of rotary adjustment about its lower axis of return. Further, the two clamping groups are horizontally and vertically adjustable. The clamps of each clamping group are cam operated so that clamping takes place over a portion of the run of each, the clamps being carried by and pivotally attached to endless chains, there being two endless chains for each rotary clamping group.

3 Claims, 6 Drawing Figures

TRANSPORTATION DEVICE, IN PARTICULAR FOR SHAPED, FLEXIBLE MATERIAL

Figure 1:
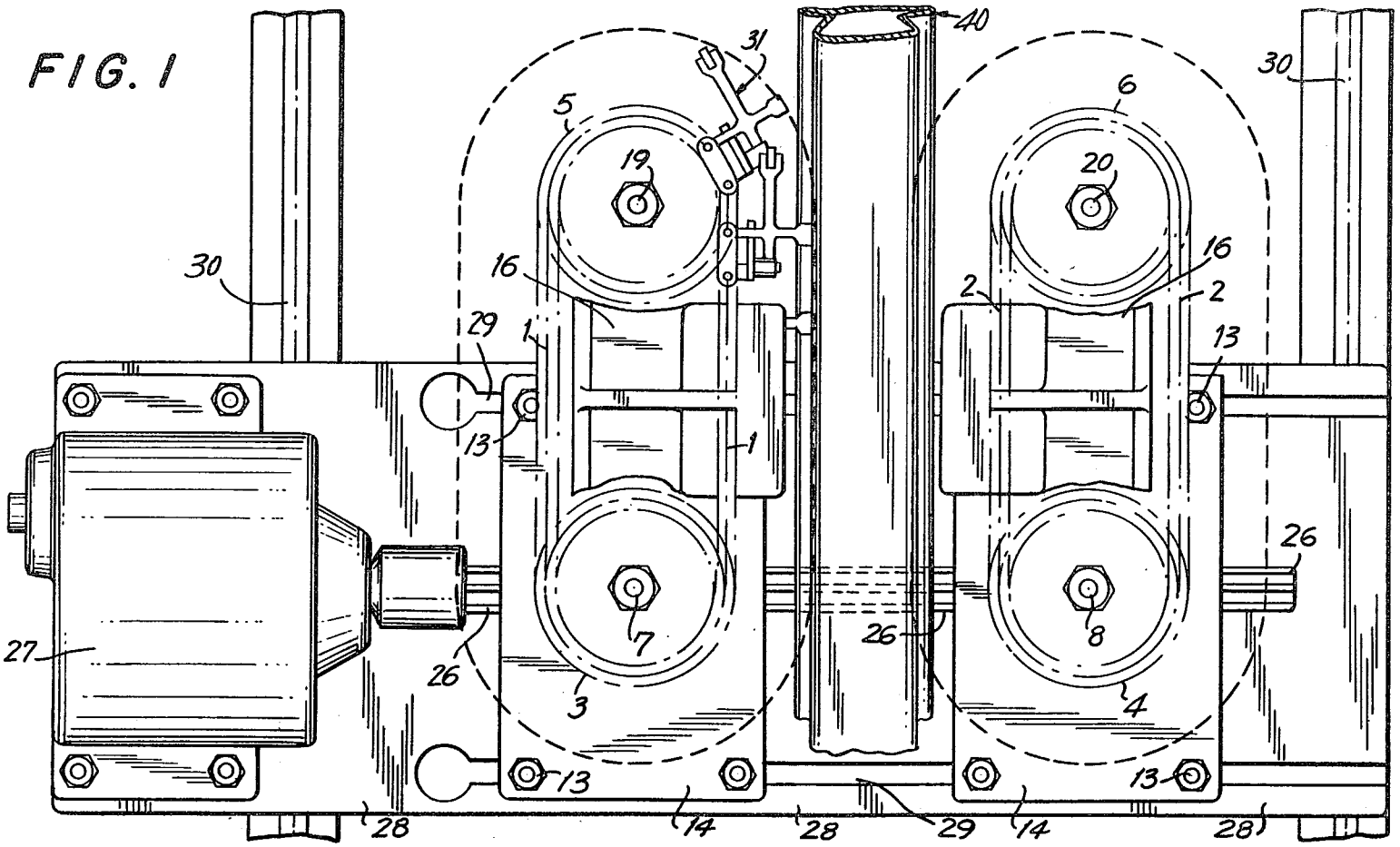

This invention concerns a transportation device, in particular for flexible material, such as paper or similar products, in the form of a band or especially a partially or totally flattened tube in an asymmetrical or symmetrical manner.

The device according to this invention is therefore particularly adapted for installation on machines producing packaging containers made of flexible material, particularly appropriate for the packaging of liquids, in which machines, starting from a continuous strip of suitable material in a heat-sealing sheet, a continuous tube is obtained which is then transformed into single packaging containers in the form of envelopes or packages, filled and sealed.

The known types of devices for the transportation or pulling of such material have clamping or similar systems, which are provided with alternating back-and-forth motion, for which reason such systems, after having grasped such material and having transported it for a certain distance, disengage from the material and must return to their starting position in order to repeat the transportation phase; the advance of the material is therefore interrupted in the case in which said clamping systems grasp both longitudinal sides of the material, or it can be continuous in case two clamping systems act on both sides of the material in an off-set motion, with the result that while one of the two systems is in the operative phase of transportation, the other one is returning to the initial position. These known devices present limitations and disadvantages: the motion with which the clamping systems are endowed, being of an alternating nature, has inherent within it a limitation of the attainable speed for advancing the material, and consequently a limitation of the operation of the machine in which the device is installed, and it results in a substantial complexity of construction and operation; the movement of advancing the material is interrupted and therefore it is difficult to obtain regularity in such advancing. Another problem which limits the functionality of the known transportation devices is that of the adjustability of the positions of the clamping or similar systems, for purposes of attaining the optimum conditions for grasping the material to be transported.

The purpose of this invention is therefore that of obviating the limitations and disadvantages of the previous technique, by a web transport device, in particular for flexible web material, which will permit a high speed of advancement of the material to be transported and insuring a perfect regularity in such advancement. The device displays the feature, among others, of adjustable positioning which provides the device with the best manner of handling and grasping the material under various conditions and offers a notable simplicity of construction and operation.

This purpose is achieved, according to this invention, by means of a continuous web transport device which includes two separate and opposing clamp groups, each continuously rotationally moving. The two groups are symmetrical, with the clamps of each approximately grasping the opposing longitudinal edges of the web material to be transported. The web material is shown as a tube of asymmetrically flattened flexible material. The device includes means for regulating and adjusting the rotating means web transport. The position of the two groups of clamps can be varied to operate in the vertical position, in the horizontal position, and the orientation or inclination may be varied.

The web transport device comprises, according to a preferred embodiment of the invention, for each one of said two groups of clamps, an endless chain, held in continuous rotation (obviously, said rotation can also be interrupted, if desired) on a carrying reel and on a drive reel. The two carrying reels of the two chains are driven by a motor system, by means of any suitable, known transmission, preferably for example by means of a common drive shaft and two units with beveled gears which transmit the motion of said shaft to two other shafts, on each one which is splined one of the two chain-carrying reels.

Each one of said clamps comprises, two opposing levers, essentially symmetrical, each pivoting on one of its ends on a common strip held by a link of said chain, and the other free end of each one of said levers having a roller. Further, each one of said levers has a head, and the two heads of the two levers thus form a vice or clamp for grasping the web material to be transported. There are also provided along a certain part of the run of said two chains, camming guide elements which engage said rollers and cause rotation of the respective lever around its pivoting end for the closing of the clamp. The opening of the clamp is accomplished by means of an elastic element acting on said lever.

Figure 3:
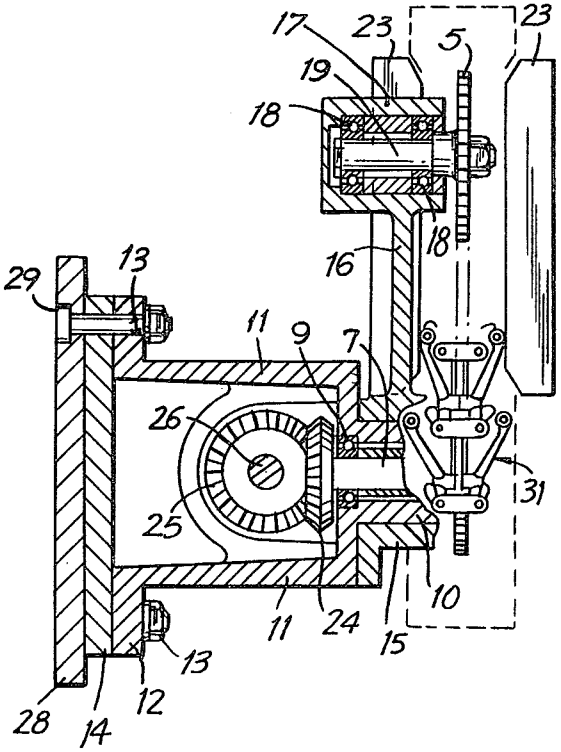
Figure 2:
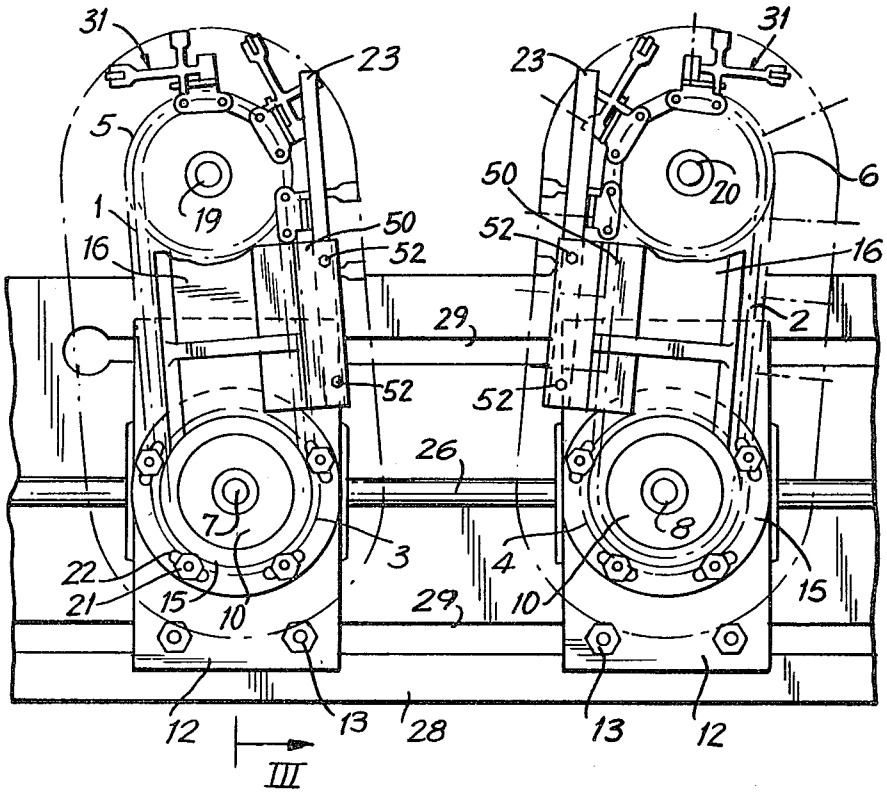
Figure 5:
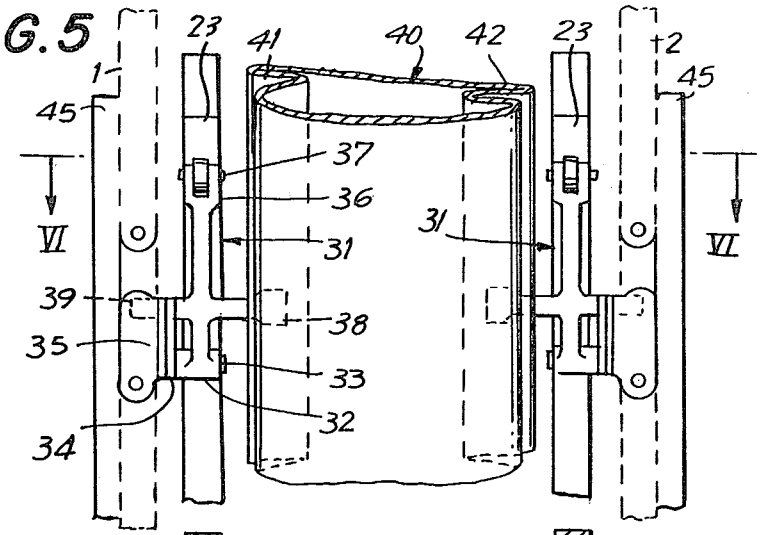
Figure 6:
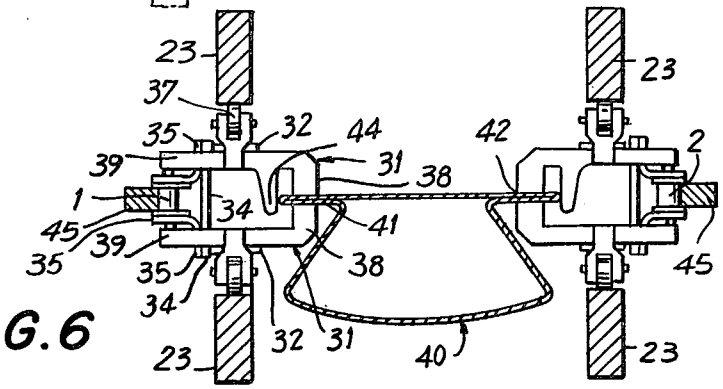
Figure 4:
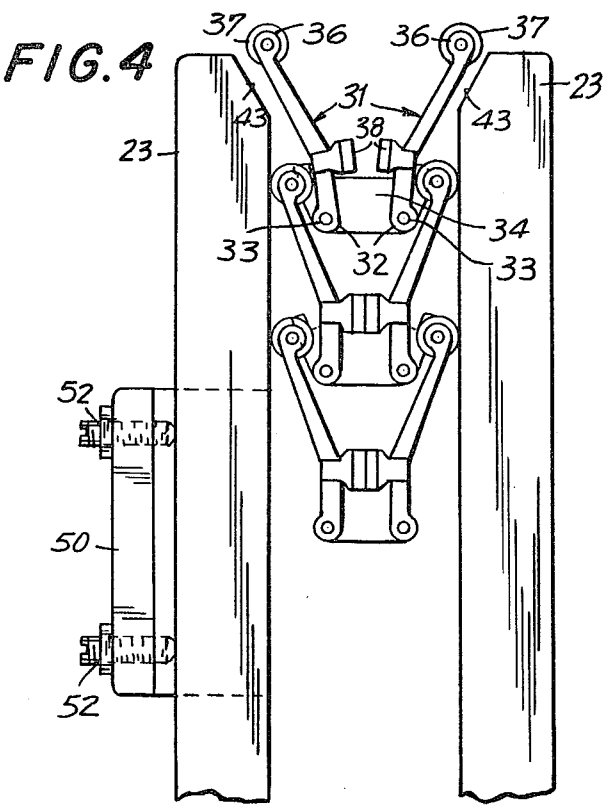

These and other features of this invention will be more evident from the following detailed description of one illustrative embodiment, with reference to the attached drawings, in which:

FIG. 1 is a front schematic view of the device according to this invention, with some components deleted for greater clarity of representation, FIG. 2 is a front schematic view of the device in FIG. 1, with some components deleted, showing, in in particular, the two groups of clamps in a position different (i.e., inclined vs. vertical) from that of FIG. 1, FIG. 3 is a section made essentially along line III—III of FIG. 2, with some parts deleted, FIG. 4 is a detailed schematic view, in a side elevation, of a portion of one of the two groups of clamps, FIG. 5 is a schematic front elevation view of clamps of the two groups, FIG. 6 is a horizontal section made essentially along line VI—VI of FIG. 5.

With reference to the figures, the device according to this invention comprises two endless chains, 1 and 2, in a vertical and parallel arrangement, a certain distance apart, held on two lower carrying reels 3 and 4, respectively, and on two upper drive reels 5 and 6 respectively. The reels 3 and 4 are splined respectively on shafts 7 and 8; each of the latter being mounted on bearings 9 (See FIG. 3), in a cylindrical extension 10 of a cylindrical housing 11 integral therewith, by means of its rectangular flange 12 and fastening elements 13 secured to a rectangular plate 14. On said cylindrical extension 10 there is mounted for rotary motion (in the plane of FIG. 2) the lower ferruled cylindrical end 15 of a movable frame 16, at the top 17 of which there is mounted, by means of bearings 18, a shaft 19 and 20, respectively, of said drive reels 5 and 6, respectively.

The regulation and the adjustment of the desired inclined position of the two movable frames 16 (see FIG. 2), is effected by means of a pin coupling 21 and slot 22 located, respectively, in the cylindrical housing 11 and the cylindrical ferrule or bushing 15.

On each of said frames 16 there are also attached integrally two vertical cam-guide components, arranged equidistantly from either side of the plane containing the respective pair of reels 3 and 5, and 4 and 6, respectively.

On the end of each one of said shafts 7 and 8 inside the respective housing 11, there is splined a beveled toothed wheel 24 (FIG. 3) which engages a beveled toothed wheel 25, splined on a transmission shaft 26 which is driven my means of a motor 27 (FIG. 1).

The two rectangular plates 14 are mounted in a horizontally displaceable and attachable manner on a plate 28, by means of a coupling between said elements 13 and two horizontal parallel guide grooves 29 cut into said plate 28. This latter component is likewise mounted vertically and attachable to vertical guides 30.

Each one of said chains 1 and 2 holds a series of clamps, of which each one comprises two opposing and symmetrical levers 31, pivotally mounted on their ends 32 on pins 33. The two pins 33 of each clamp are mounted on a strip 34 which is integral with two tabs 35 attached to a link of the conveyor chain. The other free end 36 of each lever 31 carries a roller 37, which is freely turnable. From each of said levers 31 there also is carried on one side thereof a head 38 for clamping, and on the othe side a free arm over the respective conveyor chain.

During the operation of the device, the web material to be transported, in this case a tube 40 of flexible material asymmetrically flattened, is clamped and caused to advance by virtue of the closing on either side, over its two edges 41 and 42 of said tube 40, of the two clamping heads 38. This closing is accomplished by virtue of the engagement of rollers 37 with the cam surfaces 43 of said guide components 23. There are provided an elastic return means (not shown) acting on lever 31 in order to reopen them as they are successively disengaged from guide elements 23. The clamping force of clamps 38 may be adjusted by means of threaded bolts 52 mounted in plates 50 carried by the frame.

The exact centering of the tube 40 between the two groups of clamps during its transport is obtained by means of the engagement of edges of its flanges 41 and 42 with shoulder extension 44 (FIG. 6) of one of the two levers 31 of each clamp. The motion of the chains 1 and 2 in planes parallel to that of FIG. 2 is in turn assured by their sliding against stationary ledges 45 (FIGS. 5 and 6), positioned along that portion of the run along which or during which the clamps 38 clamp tube 40.

A continuous, very fast and perfectly regular web transport is obtained. The high degree of mobility of the positioning of the two groups of clamps, accomplished by means of the illustrated means of adjustment of the vertical and horizontal positions, as well as the inclination of the chains and therefore of the two groups of clamps, makes it possible also to attain the optimum conditions of clamping between the clamps 38 and the tube 40. In the position shown, the web 40 is transported downwards in FIG. 4.

I claim:

1. A device for transporting along its length a continuous web, including rotary means for clamping, the rotary means having two separate, opposing clamp groups being substantially equal and symmetrical, the clamp groups grasping the opposite longitudinal edges of the web to be transported and wherein said rotary means for clamping comprises, for each one of said two groups of clamps, an endless chain, supported on a carrying reel and on a drive reel, the two carrying reels being powered by a motor system, and wherein each one of said clamps in said groups comprises two opposing and symmetrical levers, pivoting at one of their ends on strip elements carried by said endless chain, the other free end of each one of said levers carrying a roller, each one of said levers having a head between its ends the two heads of the two levers of each clamp forming a clamp for grasping the web material to be transported, cam guide elements which engage said roller which cause the rotation of the respective lever around said lever pivoting end, to thereby actuate said clamps.

2. A web transport device according to claim 1, wherein one of the two levers of each clamp also has a shoulder extension engaging the rim of the clamped web material during its transport, for exact positioning of the web between the two clamp groups.

3. A web transport device according to claim 1 which also includes means for adjusting with respect to the web material to be transported, the position of said two groups of clamps, wherein said adjusting means includes elements for adjusting the vertical position, the horizontal position and the inclination of said two groups of rotary clamps and said adjusting means comprises a vertical guide, a plate movable and attachable along said vertical guide, a horizontal guide on said plate, an additional plate, for each one of said clamp groups, movable and attachable along said horizontal guide, and supporting said clamp groups and a frame also for supporting each of said clamp groups, each frame connected with said rotary clamps and mounted in a rotary and adjustable manner at one of its ends to a pivot supported by said additional plate.

* * * * *